US006590467B2

(12) United States Patent
Hasegawa

(10) Patent No.: US 6,590,467 B2
(45) Date of Patent: Jul. 8, 2003

(54) NONRECIPROCAL CIRCUIT DEVICE WITH WIDE INTERCONDUCTORS SPACING ORTHOGONAL TO YOKE SIDEWALLS

(75) Inventor: Takashi Hasegawa, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 57 days.

(21) Appl. No.: 09/764,755

(22) Filed: Jan. 18, 2001

(65) Prior Publication Data

US 2001/0019296 A1 Sep. 6, 2001

(30) Foreign Application Priority Data

Jan. 19, 2000 (JP) ..... 2000-009838

(51) Int. Cl.[7] ..... H01P 1/383
(52) U.S. Cl. ..... 333/1.1; 333/24.2
(58) Field of Search ..... 333/1.1, 24.2; H01P 1/36, 1/383

(56) References Cited

U.S. PATENT DOCUMENTS 5,638,032 A 6/1997 Hasegawa ..... 333/1.1
5,748,052 A 5/1998 Hasegawa ..... 333/1.1
6,396,361 B1 * 5/2002 Horio et al. ..... 333/1.1

FOREIGN PATENT DOCUMENTS

| | | | |
|---|---|---|---|
| DE | 2917124 | 11/1980 | |
| EP | 0 682 380 A1 | 11/1995 | |
| FR | 2 805 085 | 8/2001 | |
| JP | 7307603 | 11/1995 | ..... H01P/1/383 |
| JP | 8-008613 A | 1/1996 | |
| JP | 9-055607 A | 2/1997 | |
| JP | 1168412 | 3/1999 | |

OTHER PUBLICATIONS

Search Report dated Jun. 26, 2001 in the corresponding British application (GB 0101449.7).

* cited by examiner

*Primary Examiner*—Justin P. Bettendorf
(74) *Attorney, Agent, or Firm*—Keating & Bennett, LLP

(57) ABSTRACT

A nonreciprocal circuit device is provided which has an improved reflection characteristic of the port of the center conductor which is disposed orthogonally to the side-walls of a yoke. In this nonreciprocal circuit device, the conductor width of one center conductor which is disposed orthogonally to the side-walls of the yoke is made wider than that of each of the two other center conductors.

7 Claims, 11 Drawing Sheets

NONRECIPROCAL CIRCUIT DEVICE WITH WIDE INTERCONDUCTORS SPACING ORTHOGONAL TO YOKE SIDEWALLS

BACKGROUND OF THE INVENTION

1. Field of the Invention

The present invention relates to a nonreciprocal circuit device such as an isolator or a circulator used in a high-frequency band such as the microwave band, and to a communication device using the same.

2. Description of the Related Art

Generally, the nonreciprocal circuit device such as a concentrated-constant type isolator or circulator is used in communication devices and the like, taking advantage of its characteristics that it exhibits a very low attenuation in the transmission direction of a signal, while it exhibits a very high attenuation in the opposite direction.

FIG. 9 is an exploded perspective view showing a conventional isolator, and FIG. 10 shows the inner structure thereof. In this isolator, a case 7 made of resin is disposed on a U-shaped lower yoke 8 which has right and left side-walls 8*b* and a bottom wall 8*a,* a magnetic assembly 5 comprising center conductors 51, 52, and 53, and a magnetic body 55, capacitors for matching C1, C2, and C3, and a terminating resistor R are provided in the terminal case 7, a permanent magnet 3 is disposed thereon, and a box-shaped upper yoke 2 is mounted on a lower case 8 so as to cover the upper portion in its entirety. The upper yoke 2 and the lower yoke 8 are connected together at two opposing side-walls of the upper yoke 2 and the two side-walls 8*b* of the lower yoke 8, and form a substantially square-tubular shaped yoke which has a top wall, a bottom wall, and two side-walls continuous with the top and bottom walls. These upper and lower yokes 2 and 8, and the permanent magnet constitutes a magnetic closed circuit.

All center conductors 51 through 53 are arranged so that the common ground portion thereof abuts against the bottom surface of the magnetic body 55, and that these center conductors intersect one another at an angle of substantially 120 degrees on the top surface of the magnetic body 55, passing through the side surfaces of the magnetic body 55. The ports P1 and P2 of the respective center conductors 51 and 52 are connected to input/output terminals 71 and 72 and capacitors C1 and C2 each formed in the terminal case 7. The port P3 of the center conductor 53 is connected to the capacitor C3 and the terminating resistor R, and one-side ends of all capacitor C1 through C3 and the terminating resistor R are connected to a ground terminal 73. The common ground portion of all center conductors 51 through 53 is connected to the bottom wall 8*a* of the lower yoke 8.

One center conductor 53 is disposed orthogonally to the opposing side-walls 8*b* of the upper and lower yokes 2 and 8, and the other center conductors 51 and 52 are disposed so as to intersect the center conductor 53 at an angle of substantially 120 degrees.

In such a nonreciprocal circuit device, as shown in FIG. 11, the current i flowing through each of the center conductors (in FIG. 11, only the nonreciprocal circuit device 53 is shown) is split into the upper yoke and the lower yoke from the ground portion. At this time, if the center conductors 51 through 53 having the same conductor width and inter-conductor spacing are used, the current flowing from the center conductor 53 which is disposed orthogonally to the side-walls 8*b* of the lower yoke 8, to the upper yoke 2 will be larger than the current flowing from the two other center conductors 51 and 52 to the upper yoke 2, while the current flowing from the center conductor 53 to the lower yoke 8 will be smaller than the current flowing from the two other center conductors 51 and 52 to the lower yoke 8. This is because the center conductor 53 is disposed closer to the side-walls 8*b* of the yoke than the two other center conductors 51 and 52, and because the current path thereof on the upper yoke 2 becomes shorter. As a result, the magnetic flux passing through the magnetic body 55 due to the current i3 of the center conductor 53 orthogonal to the side-walls 8*b* of the yoke, becomes smaller than the magnetic flux passing through the magnetic body 55 due to each of the current i1 and i2 of the respective other center conductors 51 and 52. Thereby, the coupling of the center conductor 53 orthogonal to the side walls 8*b* of the yoke, with the other center conductors 51 and 52 becomes weak, and thereby the impedance at the port of the center conductor 53 (hereinafter, referred to as a "port impedance") becomes higher than the impedance of the two other center conductors 51 and 52.

Typically, the impedance of an input/output portion in the circuit where these nonreciprocal circuit devices are used has a predetermine value (usually 50 Ω), and the impedance at each port in the nonreciprocal circuit device is also set to be a predetermined equal value.

However, in the conventional center conductor, as described above, since the center conductor disposed orthogonally to the side-walls of the yoke has a higher port impedance than two other center conductors, a problem occurs that the reflection characteristics of the port of this center conductor deteriorates.

Japanese Unexamined Patent Application Publication No. 7-307603 discloses a nonreciprocal circuit device wherein the conductor widths and the inter-conductor spaces of three center conductors are set for each port, but the dispositional relation between these center conductors and the side-walls of a yoke is not treated for this nonreciprocal circuit device. The present inventor has investigated the dispositional relation between the center conductors and the side-walls of the yoke in order to solve the above-described problem.

SUMMARY OF THE INVENTION

It is, therefore, an object of the present invention to provide a nonreciprocal circuit device which has an improved reflection characteristics of the port of the center conductor which is disposed orthogonally to the side-walls of a yoke, and to provide a communication device using the same.

In order to achieve the above-described object, the present invention provides a nonreciprocal circuit device comprising a yoke having a top wall, a bottom wall, and two opposing side-walls connected with said top wall and said bottom wall, said yoke accommodating a permanent magnet and a magnetic body, in which the magnetic body includes three center conductors arranged to intersect one another at a predetermined angle, provided in an electrically insulated state from one another, and one of which is disposed substantially orthogonal to the side-walls of the yoke.

In this nonreciprocal circuit device, the conductor width of the center conductor which is disposed substantially orthogonal to the side-walls of the yoke is set to be wider than the conductor width of each of the two other center conductors. Furthermore, when each of the center conductors is constituted of a plurality of conductors, the inter-conductor spacing of the center conductor which is disposed substantially orthogonal to the side-walls of the yoke, is set to be wider than the inter-conductor spacing of each of the two other center conductors.

In accordance with this construction, the port impedance of the center conductor disposed substantially orthogonal to the side-walls of the yoke decreases, and thereby the reflection characteristics of this center conductor can be improved. Specifically, in the present invention, in order to bring the port impedance of the center conductor which is disposed substantially orthogonal to the side-walls of the yoke close to the impedance of the two other center conductors, the conductor width or the inter-conductor spacing of the center conductor which is disposed substantially orthogonal to the side-walls of the yoke, is set to be wider than the conductor width or the inter-conductor spacing of each of the two other center conductors. This allows each port to achieve an appropriate impedance matching, which results in improved reflection characteristics at the port of each of the center conductors.

Preferably, each of the center conductors is constituted of two conductors. This allows insertion loss to be reduced by a simple structure.

Also, it is preferable that a terminating resistor be connected to any one of the center conductors to form an isolator. In this case, since the port of the center conductor which is disposed substantially orthogonal to the side-walls of the yoke has an impedance more prone to deviate than the impedances of the port of the other center conductors, the port of this center conductor is suitable for an isolation port which can be terminated by a resistor having an arbitrary resistance value. It is, therefore, preferable to connect a terminating port to this port.

Moreover, a communication device in accordance with the present invention is implemented by comprising a nonreciprocal circuit device having the above-described features. A communication device having superior characteristics can thereby be achieved.

The above and other objects, features, and advantages of the present invention will be clear from the following detailed description of the preferred embodiments of the invention in conjunction with the accompanying drawings.

DESCRIPTION OF THE PREFERRED EMBODIMENTS

Figure 1:
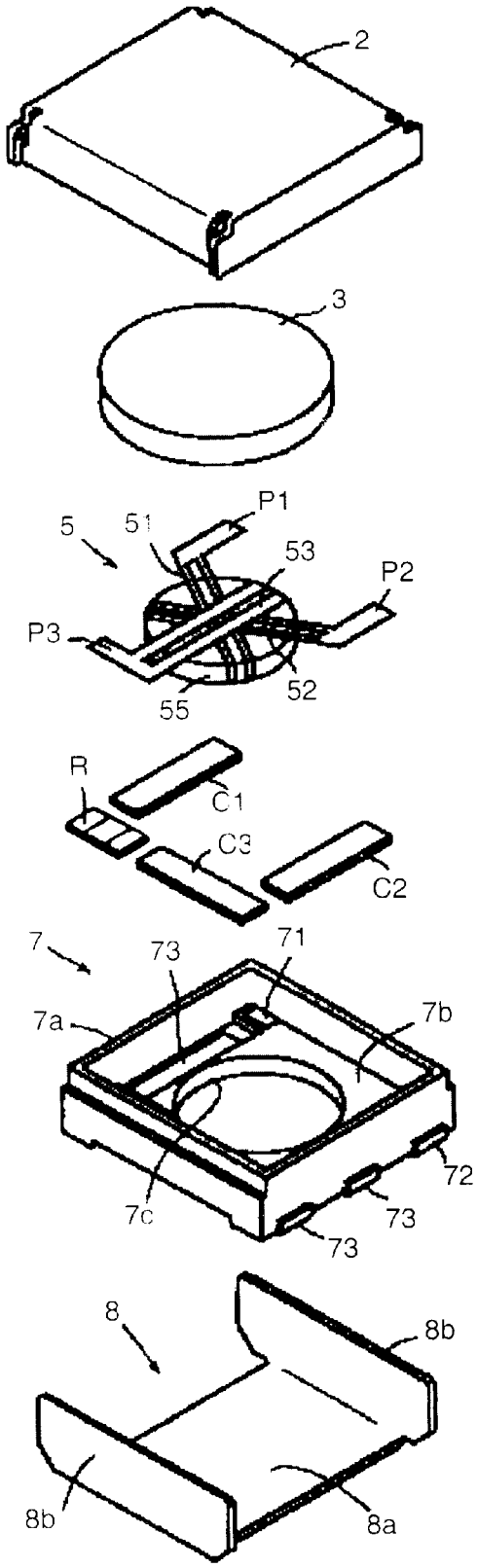
FIG. 1 is an exploded perspective view showing the overall structure of an isolator in accordance with a first embodiment of the present invention.
Figure 2:
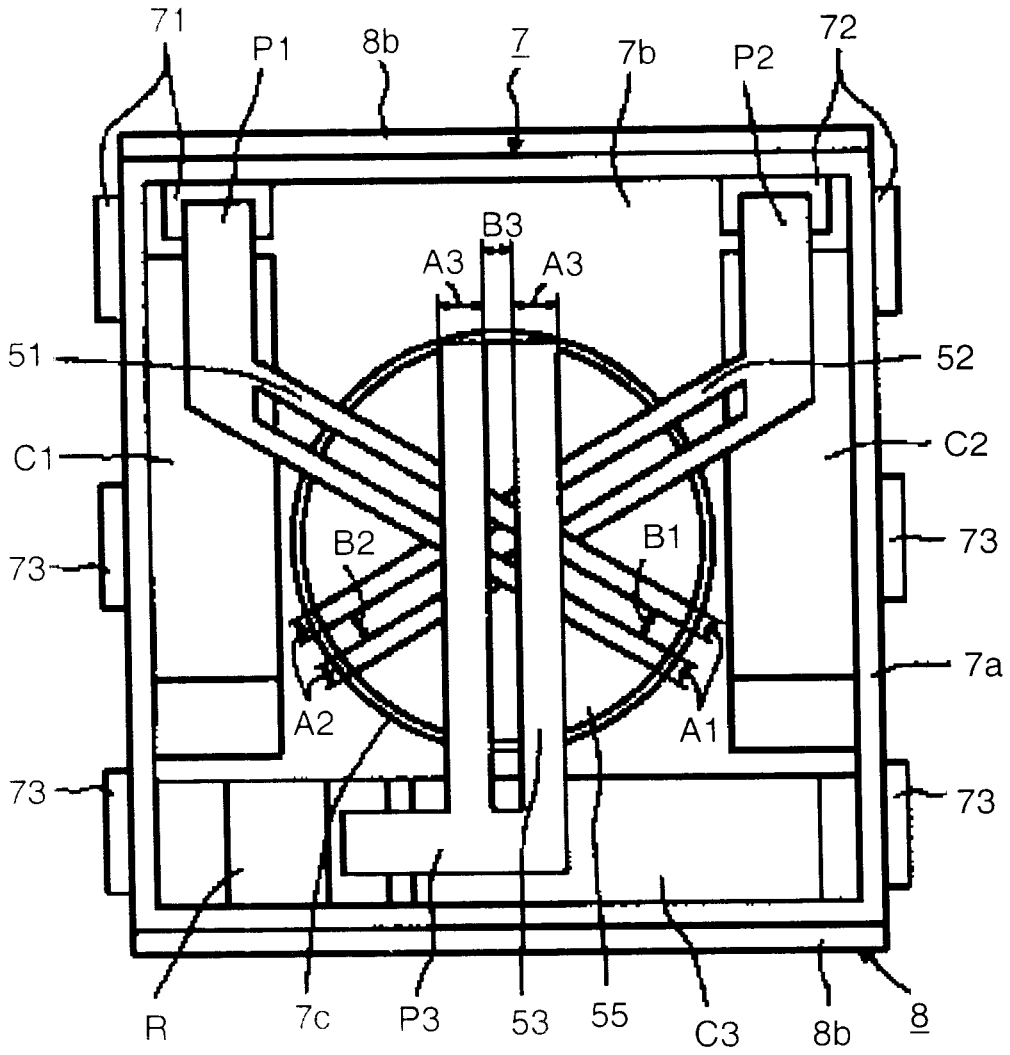
FIG. 2 is a plan view showing the isolator in accordance with the first embodiment, from which a permanent magnet and an upper yoke have been removed.

The construction of a nonreciprocal circuit device in accordance with a first embodiment of the present invention will be described with reference to FIGS. 1 and 2. FIG. 1 is an exploded perspective view showing the overall structure of an isolator, and FIG. 2 is a plan view showing the isolator from which an upper yoke and a permanent magnet have been removed.

In the isolator in accordance with this embodiment, a terminal case 7 is disposed on a substantially U-shaped lower yoke 8. A magnetic assembly 5 comprises center conductors 51, 52, and 53, and a magnetic body 55. The magnetic assembly 5, capacitors for matching C1 through C3, and a terminating resistor R are provided in the terminal case 7, a permanent magnet 3 is disposed thereon, a box-shaped upper yoke 2 is mounted on the lower yoke 8 so as to cover the upper portion in its entirety. A DC magnetic field is applied to the magnetic assembly 5 by the permanent magnet 3.

The upper yoke 2 and the lower yoke 8 are formed by stamping out a plate of a magnetic metal such as mild iron and by bending the stamped plate. The upper yoke 2 has a top wall and four side-walls, and the lower yoke has bottom wall 8*a* and opposing right and left side-walls 8*b*. The upper yoke 2 and the lower yoke 8 are connected together at the two opposing side-walls of the upper yoke 2 and the two side-walls 8*b* of the lower yoke 8, using solder, a conductive adhesive, etc. In the yoke constituted of these upper and lower yokes 2 and 8, the top and bottom walls are continuous with each other on the side-wall sides of the lower yoke, the top and bottom walls constitute a tubular structure wherein the top and bottom walls are discontinuous with each other on the sides orthogonal to these side-wall sides. The yoke thus forms a magnetic closed circuit, and also performs a function of an external case for accommodating all components.

The center conductors 51, 52, and 53 are formed by stamping out a plate of a metal conductor such as copper, integrally connected at a ground portion constituting a common ground end, and protrudes to the outside. The magnetic assembly 5 has a construction wherein the magnetic body 55 is placed on the common ground portion 54, and wherein all center conductors 51 through 53 are disposed on the top surface of the magnetic body 55 so as to wrap the magnetic body 55 by folding these center conductors, while forming an angle of substantially 120 degrees with respect to one another, with an insulating sheet (not shown) interposed between the center conductors. Each of the ports P1 through P3 constituting the tip portions of the respective center conductors 51 through 53 has a shape suitable for making connection with the other members, and is formed so as to protrude from the outer periphery of the magnetic body 55 to the outside. Each of the center conductors 51 through 53 is constituted of two conductors, the center conductor 53 is disposed orthogonally to the opposing side-walls 8*b* of the lower yoke 8, and the other center conductors 51 and 57 are disposed so as to intersect the center conductor 53 at an angle of substantially 120 degrees.

In this embodiment, each of the conductor widths A3 of the center conductor 53 which is disposed orthogonally to the side-walls of the yoke, is made wider than each of the conductor widths A1 and A2 of the respective other center conductors 51 and 52. That is, in this embodiment, the conductor width A3 of the two conductors constituting the center conductor 53 which is disposed orthogonally to the side-walls of the yoke, is set to be wider than the conductor widths A1 and A2 of the respective other center conductors 51 and 52. Herein, the inter-conductor spacings B1, B2, and B3 of the respective center conductors 51, 52, and 53 have the same dimension.

The terminal case 7 is constituted of electrical insulating material, and is constructed by integrally forming a bottom wall 7*b* with a rectangular-frame shaped side-wall 7*a*. Input/output terminals 71 and 72, and a ground terminal 73 is partially embedded in resin, an insertion hole 7*c* is formed at the substantially central portion of the bottom wall 7*b*, and a plurality of recesses are provided at predetermined places on the peripheral edge of the insertion holes 7*c*.

In the recesses formed on the peripheral edge of the insertion holes 7*c*, there are provided the capacitors for matching C1 through C3, and the terminating resistor R. The magnetic assembly b is inserted into the insertion hole 7*c*, and the permanent magnet is disposed above the magnetic assembly 5. The common ground portion 54 on the bottom wall of the magnetic assembly b is connected to the bottom wall 8*a* of the lower yoke 8. The lower-surface electrodes of the capacitors for matching C1 through C3, and the electrode of one end side of the terminating resistor R are each connected to a ground terminal 73. The ports P1 through P3 of the center conductor 51 through 53 are connected to the upper-surface electrode of the capacitors for matching C1 through C3, respectively, and the other end side of the terminating resistor R is connected to the port P3.

Figure 3:
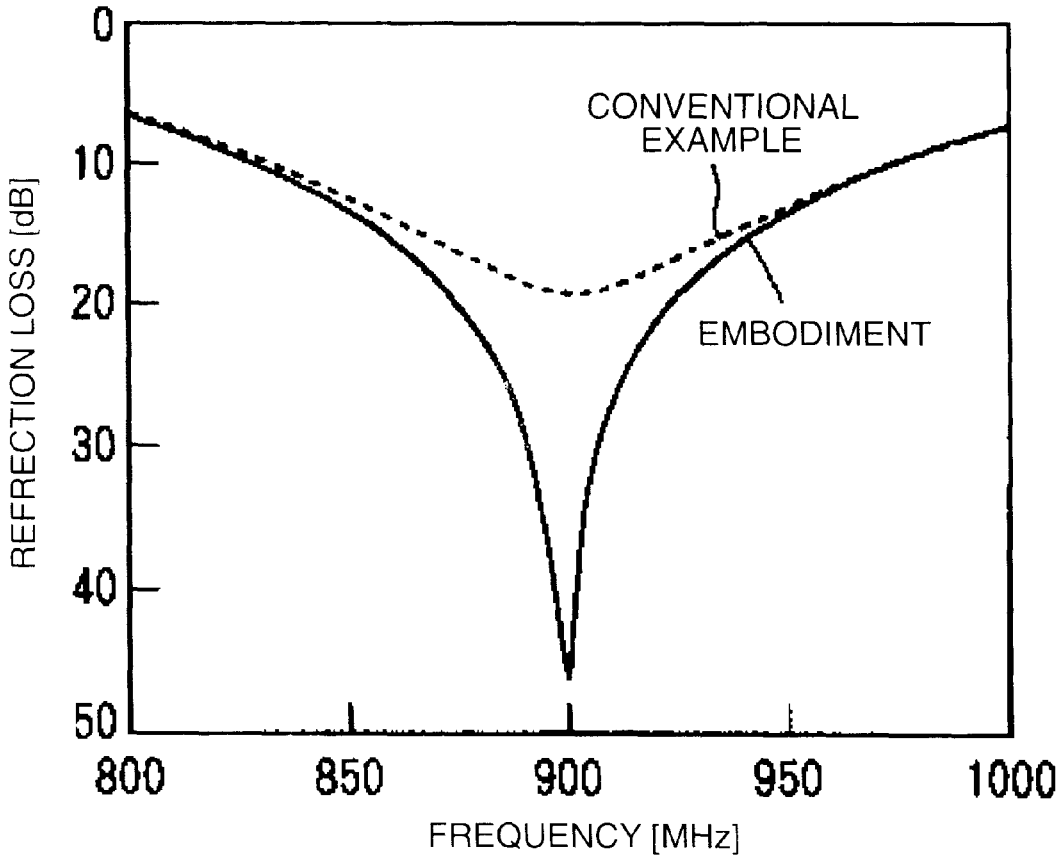
FIG. 3 is a diagram showing the reflection losses in the construction of the first embodiment and a conventional construction.

Next, the effect of construction of the first embodiment will be described with reference to FIG. 3. FIG. 3 is a diagram showing the reflection characteristics of the construction of the first embodiment and the conventional construction (all center conductors are formed so as to have the same conductor width and the same inter-conductor spacing), in the port of the center conductor 53 disposed orthogonally to the side-walls of the yoke. The dimensions of the magnetic body of each of the conventional example and the first embodiment of the present invention are 3.0 mm in diameter, and 0.5 mm thick. The center conductor 53 used in the embodiment has a conductor width of 0.3 mm and an inter-conductor spacing of 0.2 mm, and all center conductors 51 through 53 used in the conventional example and the center conductors 51 and 52 used in the embodiment has each a conductor width of 0.15 mm and an inter-conductor spacing of 0.2 mm. Saturation magnetization is set to be 0.1 T, and the impedance of a measurement system is 50 Ω. In the conventional example, the port impedance corresponding to the port P3 is approximately 60 Ω at the center frequency, while the port impedance of the port P3 of the embodiment is approximately 50 Ω at the center frequency. The impedance of the other ports are each approximately 50 Ω at the center frequency.

As shown in FIG. 3, the reflection characteristics at the port P3 of this embodiment are, in a required frequency band, significantly superior to a conventional example. For example, at the center frequency (900 MHz), the reflection loss for the embodiment is 46.6 dB in contrast to 19.1 dB for the conventional example. That is, the embodiment shows a significant improvement in the reflection characteristics over the conventional example.

As described above, in this embodiment, the center conductor that has the highest port impedance when all center conductors are formed so as to have equal conductor widths as in the case of the conventional example, that is, the center conductor 53 which is disposed orthogonally to the side-walls 8*b* of the yoke, is provided with a wider conductor width A3 than the conductor widths A1 and A2 of the other respective center conductors 51 and 52. Hence, the port impedance of this center conductor 53 decreases, and thereby the reflection characteristics of the port of this center conductor is improved. More specifically, the port impedance of the center conductor 53 is reduced by setting the conductor width A3 wider, whereby the port impedance of the center conductor 53 is brought closer to the impedance of the circuit system, that is, takes a substantially the same impedance value as the impedance values of the other center conductors 51 and 52. This allows the port impedances of all center conductors to be set so as to match to the impedance of the circuit system. Therefore, if the construction of this embodiment is used, the insertion loss can be reduced when the port of the center conductor which is disposed orthogonally to the side-walls of the yoke is employed as an input/output port, and the isolation characteristics can be improved when the port of the center conductor which is disposed orthogonally to the side-walls of the yoke is employed as an isolation port.

In the above-described embodiment, the isolator is formed by connecting the terminating resistor R to the center conductor 53 which is disposed orthogonally to the side-walls of the yoke, but the method of forming the isolator is not restricted to this. The isolator may instead be formed by connecting the terminating resistor R to either of the center conductors 51 and 52. It is, however, preferable that the terminating resistor R be connected to the center conductor 53, of which the port impedance is more prone to deviate than the port impedances of the center conductors 51 and 52, as described above. Accurately matching the resistance value of the terminating resistor R to that of the port impedance value of the center conductor 53 further improves the isolation characteristics.

Figure 4:
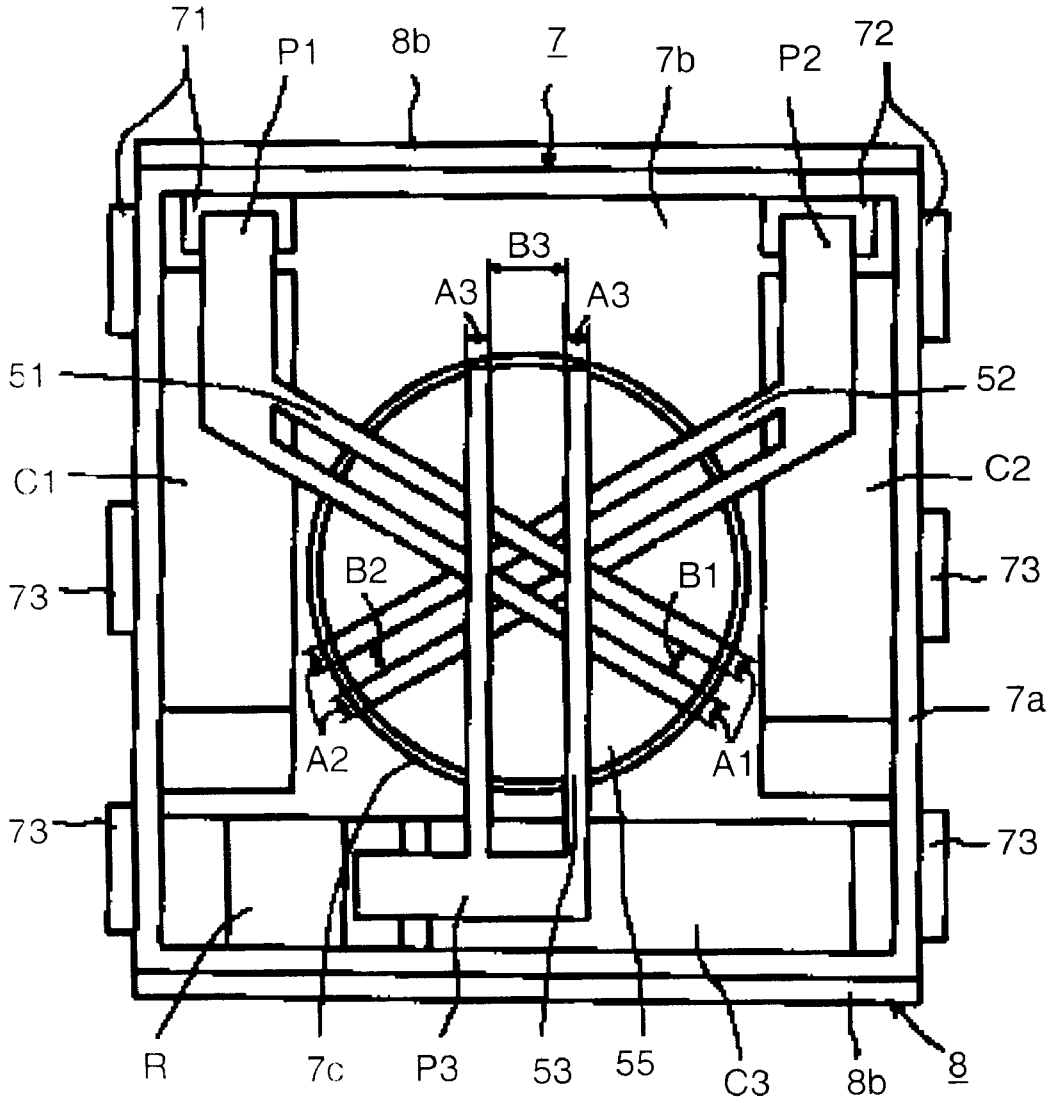
FIG. 4 is a plan view showing the isolator in accordance with a second embodiment, from which a permanent magnet and an upper yoke have been removed.

Next, the construction of an isolator in accordance with a second embodiment will be described with reference to FIG. 4. In the isolator shown in FIG. 4, each of the center conductor 51 through 53 is constituted of two conductors, and the inter-conductor spacing B3 of the center conductor 53 which is disposed orthogonally to the side-walls 8*b* of the yoke, is made wider than the inter-conductor spacings B1 and B2 of the respective other center conductors 51 and 52. That is, in this embodiment, the inter conductor spacing B3 of the two conductors constituting the center conductor 53 which is disposed orthogonally to the side-walls 8*b* of the yoke, is set to be wider than the inter-conductor spacings B1 and B2 of the respective other center conductors 51 and 52. Herein, the conductor widths A1, A2, and A3 of the respective center conductors 51, 52, and 53 have the same dimension.

Figure 5:
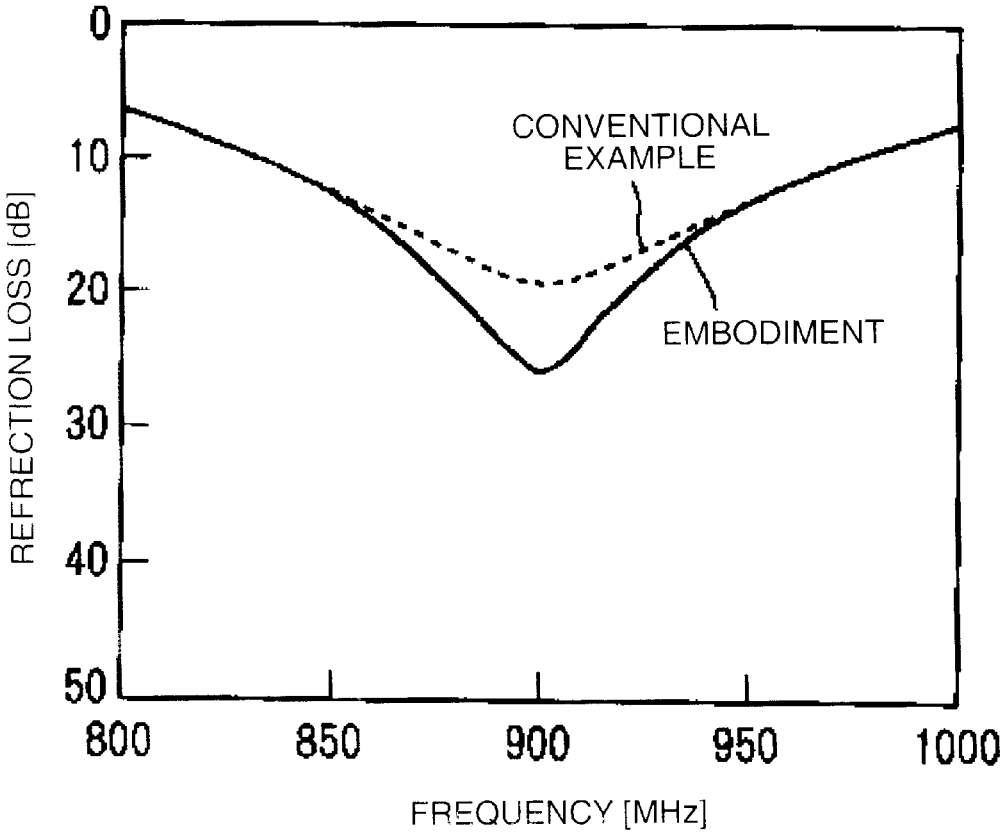
FIG. 5 is a diagram showing the reflection losses in the construction of the second embodiment and the conventional construction.

FIG. 5 is a diagram showing the reflection characteristics of the construction of the second embodiment and the conventional construction, in the port of the center conductor 53 disposed orthogonally to the side-walls of the yoke. The center conductor 53 used in the embodiment has a conductor width of 0.15 mm and an inter-conductor spacing of 0.5 mm. Other dimensions and measuring conditions are the same as those in the first embodiment. In this embodiment, the port impedance of the port P3 is approximately 55 Ω at the center frequency. The impedance of the other ports are each approximately 50 Ω at the center frequency.

As shown in FIG. 5, the reflection characteristics at the port P3 of this embodiment are, in a required frequency band, significantly superior to the conventional example. For example, at the center frequency, the reflection loss for the embodiment is 26.3 dB in contrast to 19.1 dB for the conventional example. That is, the embodiment exhibits an improvement in the reflection characteristics over the conventional example.

As described above, in this embodiment, the center conductor that has the highest port impedance when all center conductors are formed so as to have equal inter-conductor spacings as in the case of conventional examples, that is, the center conductor 53 which is disposed orthogonally to the side-walls of the yoke, is provided with a wider inter-conductor spacing B3 than the inter-conductor spacings B1 and B2 of the respective other center conductors 51 and 52. Hence, the port impedance of this center conductor 53 decreases, and thereby the reflection characteristics of the port of this center conductor is improved. More specifically, the port impedance of the center conductor 53 is reduced by setting the inter-conductor spacing B3 wider, whereby the port impedance is brought closer to the impedance of the circuit system. Therefore, if the construction of this embodiment is used, the insertion loss can be reduced when the port of the center conductor which is disposed orthogonally to the side-walls of the yoke is employed as an input/output port, and the isolation characteristics can be improved when the port of the center conductor which is disposed orthogonally to the side-walls of the yoke is employed as an isolation port.

Figure 6:
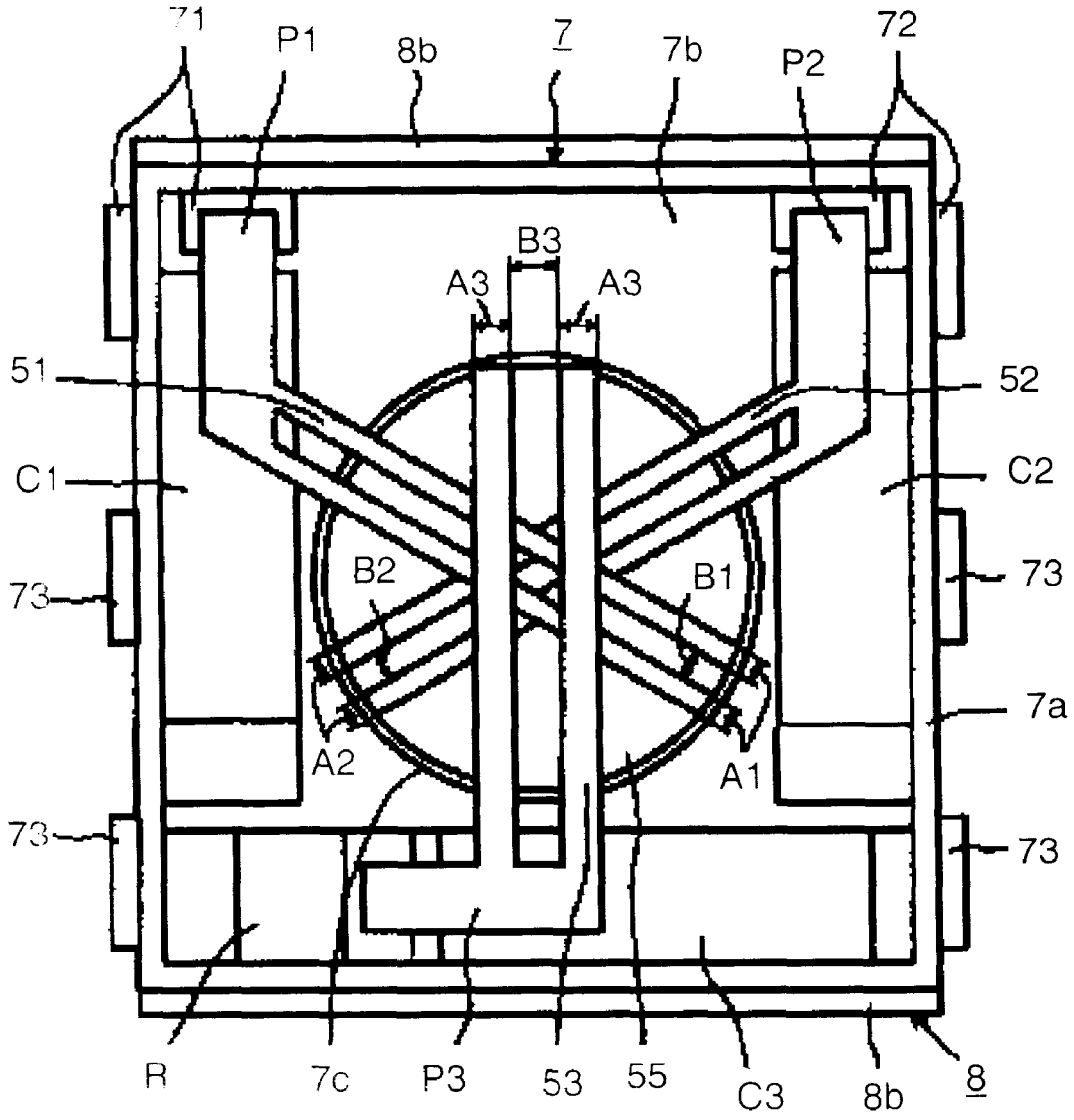
FIG. 6 is a plan view illustrating the isolator in accordance with a third embodiment, from which a permanent magnet and an upper yoke have been removed.

Next, the construction of an isolator in accordance with a third embodiment will be described with reference to FIG. 6. In the isolator shown in FIG. 6, each of the center conductor 51 through 53 is constituted of two conductors, and each of the conductor widths A3 of the center conductor 53 which is disposed orthogonally to the side-walls 8*b* of the yoke, is made wider than the conductor width A1 and A2 of the respective other center conductors 51 and 52, and the inter-conductor spacing B3 of the center conductor 53 which is disposed orthogonally to the side-walls 8*b* of the yoke, is made wider than the inter-conductor spacings B1 and B2 of the respective other center conductors 51 and 52. That is, in this embodiment, both the conductor widths A3 and the inter-conductor spacing B3 of the two conductors constituting the center conductor 53 which is disposed orthogonally to the side-walls 8*b* of the yoke, are set to be wider than the conductor widths A1 and A2 and the inter-conductor spacings B1 and B2 of the respective other center conductors 51 and 52.

Figure 7:
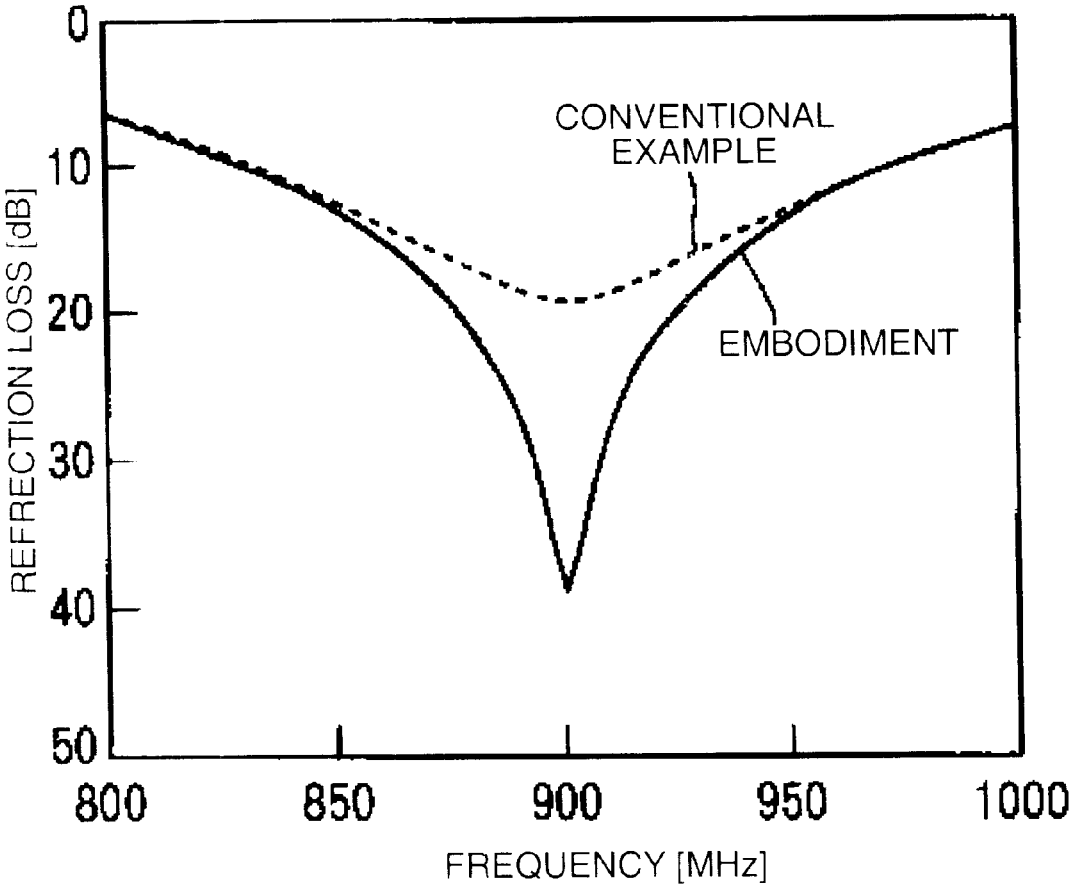
FIG. 7 is a diagram illustrating the reflection losses in the construction of the third embodiment and the conventional construction.

FIG. 7 is a diagram showing the reflection characteristics of the construction of the third embodiment and the conventional construction, in the port of the center conductor 53 disposed orthogonally to the side-walls 8*b* of the yoke. The center conductor 53 used in the embodiment has a conductor width of 0.25 mm and an inter-conductor spacing of 0.3 mm. Other dimensions and measuring conditions are the same as those in the above-described first embodiment. In this embodiment, the port impedance of the port P3 is approximately 50 Ω at the center frequency. The impedance of the other ports are each approximately 50 Ω at the center frequency.

As shown in FIG. 7, the reflection characteristics of the port P3 of this embodiment are, in a required frequency band, significantly superior to the conventional example. For example, at the center frequency, the reflection loss for the embodiment is 38.7 dB in contrast to 19.1 dB for the conventional example. That is, the embodiment shows an improvement in the reflection characteristics over the conventional example.

As described above, in this embodiment, the center conductor that has the highest port impedance when all center conductors are formed so as to have equal conductor widths and equal inter conductor spacings as in the case of conventional examples, that is, the center conductor 53 which is disposed orthogonally to the side-walls of the yoke, is provided with a wider conductor width A3 and a wider inter-conductor spacing B3 that the conductor widths A1 and A2, and the inter-conductor spacings B1 and B2 of the respective other center conductors 51 and 52. Hence, the port impedance of this center conductor 53 decreases, and thereby the reflection characteristics of the port of this center conductor is improved. More specifically, the port impedance of the center conductor 53 is reduced by setting the conductor width A3 and the inter-conductor spacing B3 wider, whereby the port impedance is brought closer to the impedance of the circuit system. Therefore, if the construction of this embodiment is used, the insertion loss can be reduced when the port of the center conductor which is disposed orthogonally to the side-walls of the yoke is employed as an input/output port, and the isolation characteristics can be improved when the port of the center conductor which is disposed orthogonally to the side-walls of the yoke is employed as an isolation port.

In the above-described embodiments, each of the center conductors 51, 52, and 53 was described as being a center conductor formed of two conductors, but the method of forming the center conductor is not restricted to this. Each of these center conductors 51, 52, and 53 may instead be formed of one conductor, or may be formed of three conductors or more.

Furthermore, in the above-described embodiments, each of the center conductors was described as being a structure wherein each of the center conductors formed of a metallic plate is folded and disposed on the magnetic body, but the structure of the center conductor is not restricted to this. The structure of each of the center conductors may instead be a structure wherein a center conductor is formed of an electrode film on the inside or the surface of a dielectric body or a magnetic body. Also, the shape of the permanent magnet 3 is not limited to a circular shape, but a polygonal shape such as a quadrangular shape in a plan view may be used.

Moreover, in the above-described embodiments, an isolator wherein a terminating resistor is connected to one port P3 was explained by way of example. However, the present invention can also be applied to a circulator which uses the port P3 as a third input/output port without connecting the terminating resistor R to the port P3.

Also, in the above-described embodiments, the yoke is formed by connecting the upper yoke and the lower yoke together, but the method of forming the yoke is not limited to this. A substantially square-tube shaped yoke which is unitarily formed using one material may instead be used.

Figure 8:
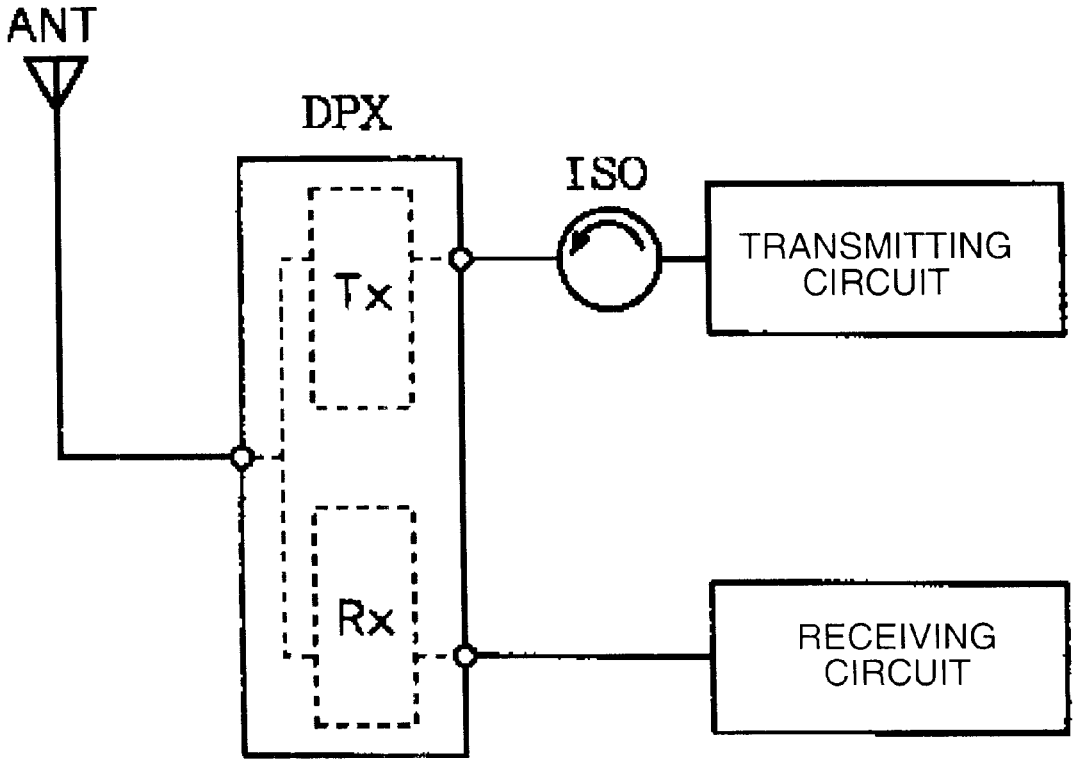
FIG. 8 is a block diagram illustrating a communication device in accordance with a fourth embodiment of the present invention.
Figure 9:
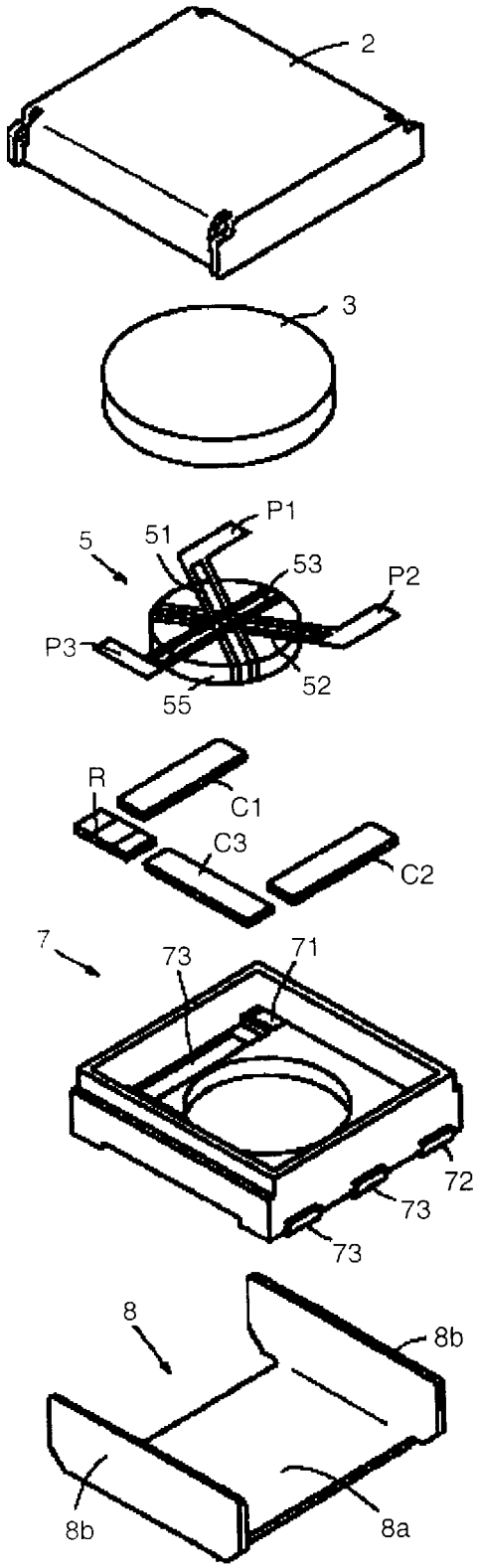
Fig.9 PRIOR ART
FIG. 9 is an exploded perspective view illustrating the overall structure of a conventional isolator.
Figure 10:
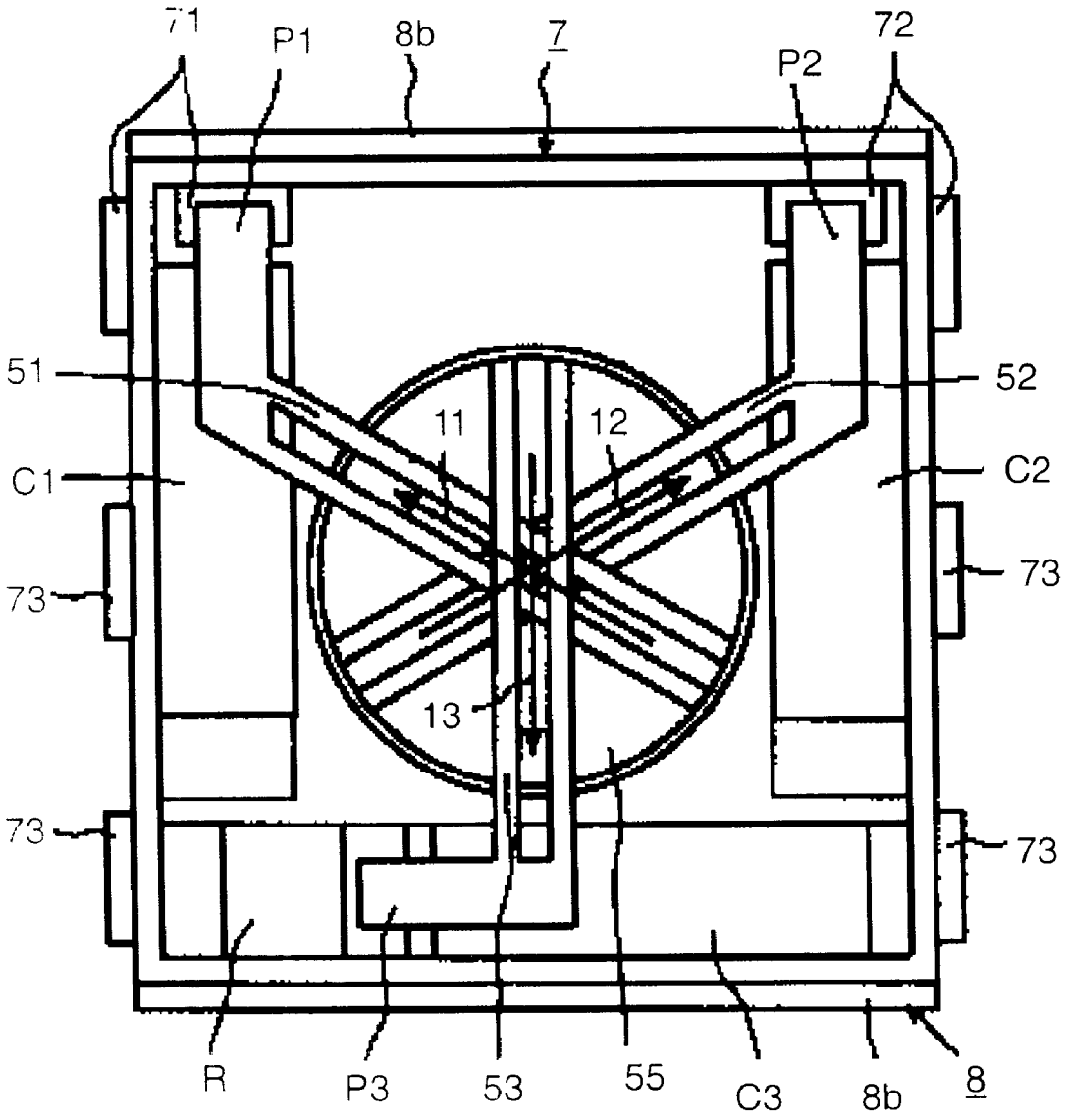
Fig.10 PRIOR ART
FIG. 10 is a plan view illustrating the conventional isolator from a permanent magnet and an upper yoke have been removed.
Figure 11:
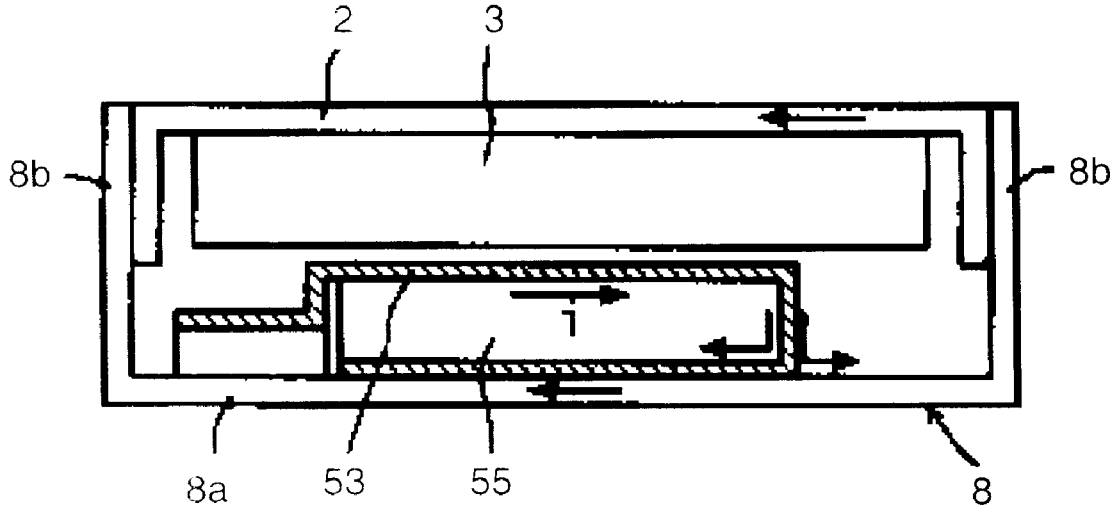
Fig.11 PRIOR ART
FIG. 11 is a schematic sectional view of the isolator shown in FIG. 10.

Next, the construction of a communication device in accordance with a fourth embodiment is shown in FIG. 8. In this communication device, an antenna ANT is connected to the antenna end of a duplexer DPX comprising a transmission filter TX and a reception filter RX, an isolator ISO is connected between the input end of the transmission filter TX and a transmitting circuit, and a receiving circuit is connected to the output end of the reception filter RX. A transmitted signal from the transmitting circuit is emitted from the antenna ANT via the isolator ISO and the transmission filter TX. The received signal which is received at the antenna ANT is input to the receiving circuit through the reception filter RX.

Here, as an isolator ISO, the isolator in accordance with each of the above-described embodiments can be used. By using the nonreciprocal circuit device in accordance with the present invention, which has improved reflection characteristics, a communication device having superior characteristics can be obtained.

As is evident from the above description, in accordance with the nonreciprocal circuit device of the present invention, since the conductor with and/or the inter-conductor spacing of the center conductor which is disposed orthogonally to the side-walls of the yoke, is set to be wider than the conductor width and/or the inter-conductor spacing of each of the other center conductors, the port impedance of the center conductor which is disposed orthogonally to the side-walls of the yoke decreases, and thereby the reflection characteristics at the port of this center conductor is improved. Therefore, the present invention allows a nonreciprocal circuit device which has low insertion loss and superior isolation characteristics to be achieved.

Furthermore, by mounting the nonreciprocal circuit device in accordance with the present invention, a communication device having superior characteristics can be realized.

While the present invention has been described with reference to what are at present considered to be the preferred embodiments, it is to be understood that various changes and modifications may be made thereto without departing from the invention in its broader aspects and therefore, it is intended that the appended claims cover all such changes and modifications as fall within the true spirit and scope of the invention.

What is claimed is:

1. A nonreciprocal circuit device comprising:

a yoke having a top wall, a bottom wall, and two opposing side-walls connected with said top wall and said bottom wall, said yoke accommodating a permanent magnet and a magnetic body;

wherein said magnetic body includes three center conductors arranged to intersect one another at a predetermined angle, provided in an electrically insulated state from one another, and one of which is disposed substantially orthogonal to the side-walls of the yoke;

each of said three conductors includes a plurality of conductors;

the width of each of the plurality of conductors of the center conductor which is disposed substantially orthogonal to the side-walls of the yoke is set to be wider than the width of each of the plurality of conductors of each of the two other center conductors; and the inter-conductor spacing of the center conductor which is disposed substantially orthogonal to the side-walls of the yoke is set to be wider than the inter-conductor spacing of each of the two other center conductors.

2. A nonreciprocal circuit device comprising:

a yoke having a top wall, a bottom wall, and two opposing side-walls connected with said top wall and said bottom wall, said yoke accommodating a permanent magnet and a magnetic body;

wherein said magnetic body includes three center conductors arranged to intersect one another at a predetermined angle, provided in an electrically insulated state from one another, and one of which is disposed substantially orthogonal to the side-walls of the yoke;

each of said three center conductors includes a plurality of conductors; and the inter-conductor spacing of the center conductor which is disposed substantially orthogonal to the side-walls of the yoke is set to be wider than the inter-conductor spacing of each of the two other center conductors.

3. A nonreciprocal circuit device as claimed in claims 2 or 1, wherein the port impedance of the center conductors is substantially the same.

4. A nonreciprocal circuit device as claimed in claims 2 or 1, wherein each of said three center conductors includes two conductors.

5. A nonreciprocal circuit device as claimed in claim 1, wherein a terminating resistor is connected to a port of any one of said three center conductors.

6. A nonreciprocal circuit device as claimed in claim 5, wherein a terminating resistor is connected to the port of the center conductor which is disposed substantially orthogonal to the side-walls of said yoke.

7. A communication device comprising:

a nonreciprocal circuit device as claimed in claim 2 or 1.

* * * * *